United States Patent [19]

Peterson

[11] 4,045,104

[45] Aug. 30, 1977

[54] CABINET STRUCTURE AND METHOD OF CONSTRUCTION

[76] Inventor: Clinton B. Peterson, 3892 Jefferson Ave., Ogden, Utah 84403

[21] Appl. No.: 606,099

[22] Filed: Aug. 20, 1975

[51] Int. Cl.[2] ..... A47B 43/00; A47F 5/14

[52] U.S. Cl. ..... 312/257 R; 312/257 SK; 312/263; 211/182

[58] Field of Search ..... 312/257 R, 257 SK, 263, 312/250; 211/182

[56] References Cited

U.S. PATENT DOCUMENTS

| | | | |
|---|---|---|---|
| 2,806,755 | 9/1957 | Glass | 312/257 SK |
| 3,087,768 | 4/1963 | Anderson et al. | 312/257 R |
| 3,182,846 | 5/1965 | La Kaff | 312/257 R |
| 3,195,968 | 7/1965 | Freeman | 312/263 |
| 3,255,721 | 6/1966 | Peterschmidt | 211/182 |
| 3,545,625 | 12/1970 | MacMillan | 312/257 R |
| 3,736,035 | 5/1973 | Brown et al. | 312/257 SK |
| 3,815,966 | 6/1974 | Lyman, Jr. | 312/250 |
| 3,835,354 | 9/1974 | Torres-Pena | 312/257 SK |
| 3,890,022 | 6/1975 | Moon | 312/257 R |

FOREIGN PATENT DOCUMENTS

| | | | |
|---|---|---|---|
| 396,345 | 1/1966 | Switzerland | 211/182 |

*Primary Examiner*—Paul R. Gilliam
*Assistant Examiner*—Victor N. Sakran
*Attorney, Agent, or Firm*—Criddle, Thorpe & Western

[57] ABSTRACT

A cabinet structure and method of construction therefor include provision of a plurality of tubular frame members having holes in the interior side walls thereof near the ends of the members, and a plurality of corner members for joining the frame members together. The corner members have a central post and a pair of legs extending from one end of the central post at substantially a right angle thereto and at substantially a right angle with respect to each other. One side of each leg is tapered to become narrower at its end and each leg has a nipple protruding from the side opposite the tapered side. The corner members are fitted in the frame members by pivoting the legs thereof into the ends of the frame members so that the nipples are received into corresponding holes in the side walls of the frame members. The frame members are generally rectangular in cross-section and includes a pair of flanges which extend in a parallel fashion from a pair of adjacent corners of the frame member. A plurality of panels are provided for fitting among the frame members in which certain of the edges of the panels are received between the flanges of certain of the frame members.

6 Claims, 6 Drawing Figures

CABINET STRUCTURE AND METHOD OF CONSTRUCTION

BACKGROUND OF THE INVENTION

This invention relates to a cabinet structure and method of construction wherein the component parts of the structure are held together in a substantially rigid, stressed attitude.

A variety of cabinet designs have been proposed in recent years, with the object of each design typically being simplicity in construction, ease of assembly, and minimization of the number of component parts. See, for example, U.S. Pat. Nos. 2,806,755, 3,272,582 and 3,815,966.

One drawback with most prior art cabinet designs is that screws or screws and bolts are typically required to maintain the structure in a rigid attitude or alternatively the structure is fabricated with the component parts permanently bonded together. In the former case, assembly of the cabinets is oftentimes difficult and, because screws tend to loosen with movement, the cabinets lose their rigidity with time. In the latter case, there is typically no rigidity problem but storage and shipping is difficult and costly because the cabinet effectively has no disassembled, compact state.

SUMMARY OF THE INVENTION

It is an object of the present invention to provide a cabinet structure and method of construction requiring few component parts.

It is also an object of the present invention to provide a cabinet structure having component parts which are substantially alike and therefore interchangeable.

It is a further object of the present invention to provide a cabinet structure requiring no bolts or screws for holding the component parts thereof together.

It is still another object of the present invention to provide a cabinet structure which may be readily assembled and disassembled and which, when assembled, is maintained in a substantially rigid, stressed attitude.

The above and other objects of the present invention are realized in an illustrative embodiment of a cabinet structure which includes a plurality of elongate frame members, and ends of which are hollowed out to define sockets. Holes are located in the side walls of certain ones of the sockets. Also included is a plurality of corner members for joining the ends of the frame members together in a stressed, substantially rigid fashion. Each corner member includes a central post adapted to slide longitudinally into the sockets of the frame members, and a pair of legs extending from one end of the central post generally at right angles thereto and at a fixed angle with respect to each other. Each leg includes a nipple protruding from one side thereof with the other side of the leg being tapered so that the end of the leg is narrower than the base thereof. With this construction, the legs of the corner members may be pivoted into the sockets of the frame members so that the nipples of the legs are received into corresponding holes in the side walls of the sockets.

When the frame members and corner members are assembled into a cabinet structure, the legs of each corner member extends generally horizontally into the sockets of adjacent ends of a pair of horizontally disposed frame members and the central posts of the corner members are received into the sockets of vertically disposed frame members. The nipples on the legs of the corner members coact with corresponding holes in the side walls of the sockets of the frame members to maintain the structure in a stressed, substantially rigid configuration.

In accordance with one aspect of the invention, the frame members include a pair of flanges which extend from one side thereof to form a generally U-shaped channel. Panels are provided for installation among the framed members with certain ones of the edges of the frame members being received in and carried by the channels of the frame members.

BRIEF DESCRIPTION OF THE DRAWINGS

The above and other objects, features and advantages of the present invention will become apparent from a consideration of the following detailed description presented in connection with the accompanying drawings in which.

DETAILED DESCRIPTION

Figure 1:
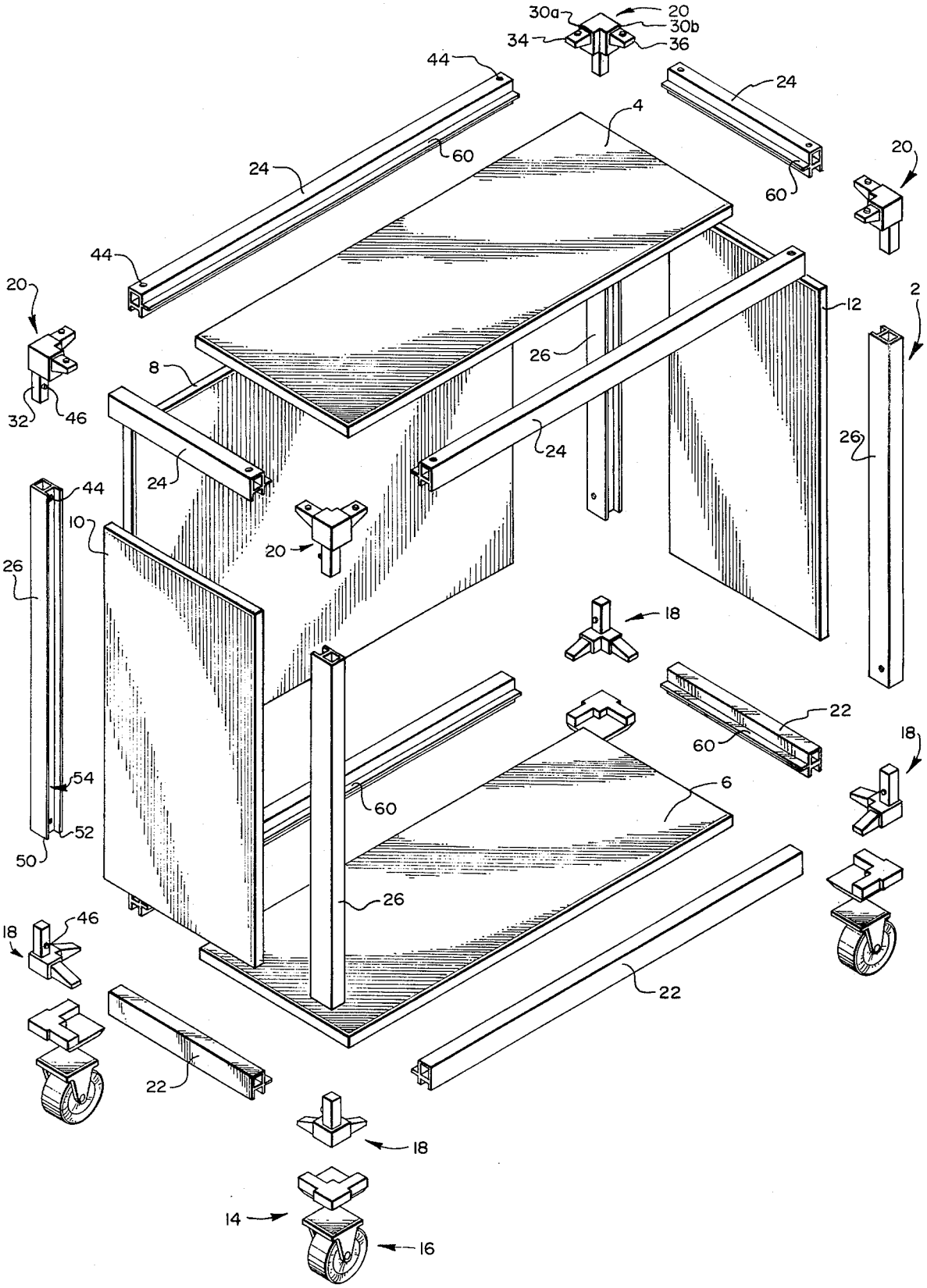
FIG. 1 is an exploded, perspective view of a cabinet structure made in accordance with the principles of the present invention.

The cabinet structure of the present invention includes a cabinet frame 2 (FIG. 1) which carries a plurality of panels such as a top panel 4, a bottom panel 6, a back panel 8, and two end panels 10 and 12. The frame 2 rests on four base members 14 which may include casters or wheels 16 for moving the cabinet. The unique configuration and design of the components of the frame 2 allow for maintaining the frame in a mechanically stressed and rigid disposition and for maintaining the panels and base members in place. Of course, sliding or hinged doors could also be mounted in the cabinet as could additional internal shelves, partitions, etc.

Figure 2A:
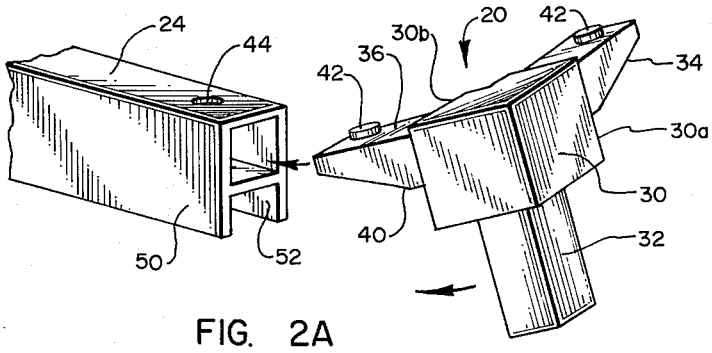
FIGS. 2A, 2B and 2C show an upper corner member and fragmented portions of frame members of the cabinet of FIG. 1 illustrating the manner of joining the corner member and frame members together.
Figure 2B:
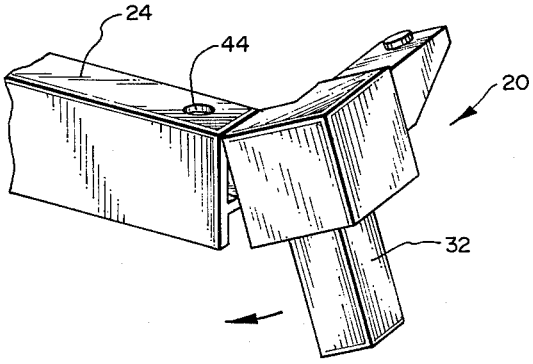
Figure 3:
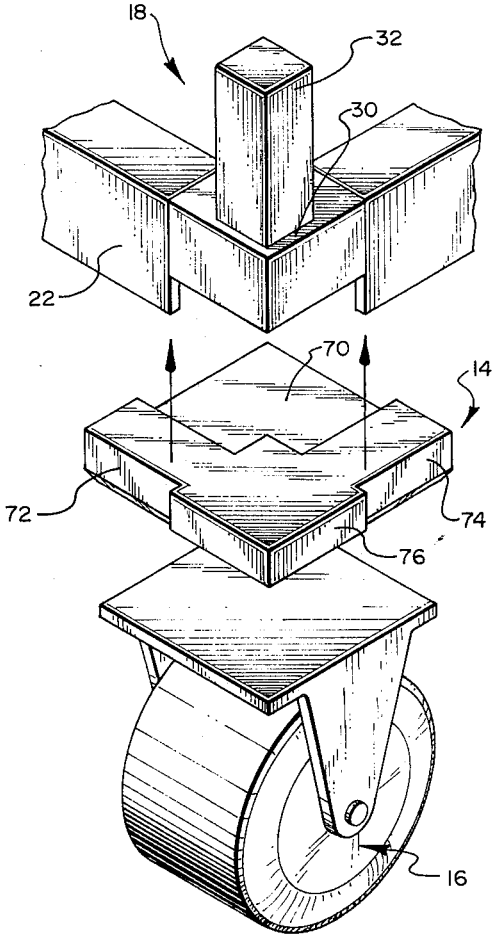
FIG. 3 shows a bottom corner member, fragmented portions of frame members joined to the corner member, and a detached base member of the cabinet of FIG. 1.

The components of the cabinet frame 2 of FIG. 1 include bottom corner members 18, top corner members 20, bottom tubular frame members 22, top tubular frame members 24 and vertical tubular frame members 26. The corner members 18 and 20 each includes a body portion 30 (composite FIG. 2), a central post 32 which projects outwardly from the body, and a pair of legs 34 and 36 projecting from the body 30 at substantially a right angle with respect to the central post 32 and with respect to each other. Although the top and bottom corner members are essentially alike, the bodies of the upper corner members 20 are somewhat thicker than the bodies of the bottom corner members 18. This is best seen in composite FIG. 2 and FIG. 3 which respectively show a top corner member and a bottom corner member. Note that the thickness of the body of the top corner member 20 is substantially the same as the thickness of the frame member 24 (composite FIG. 2) whereas the thickness of the body of the bottom corner member 18 is less than the thickness of the frame member 22 (FIG. 3).

The body 30 of the corner members has the shape of a right angle with flat end faces 30*a* and 30*b* formed at right angles to one another and out from which the legs 34 and 36 project (FIG. 1 and composite FIG. 2). The central post 32 projects either from the bottom surface of the body 30 (composite FIG. 2) or from the top surface of the body (FIG. 3).

The central post 32 of each of the corner members 18 and 20 has a substantially square cross section, as does the base portion 40 of each of the legs of the corner members 18 and 20. The side of each leg closest to the central post 32 of the corner members 18 and 20 is tapered so that the leg becomes narrower at the end thereof. The purpose of this tapering will be discussed later when describing the method of assembling the cabinet. Projecting from the side of each leg opposite the tapered side is a rigid nipple 42. The nipples 42 are generally cylindrical in shape and are adapted to be received in holes 44 located near the ends of the frame members. Each central post 32 of the corner members includes detent apparatus having a nipple 46 (FIG. 1) which is spring biased to project outwardly from one side of the central post. This structure will be described hereafter more fully in conjunction with FIG. 4.

Figure 4:
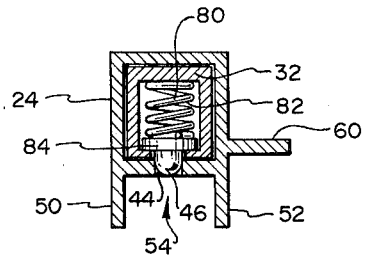
FIG. 4 is a cross-sectional view of the central post of a corner member and a frame member showing detent apparatus disposed in the central post.

The frame members are tubular or hollowed out to define sockets in the ends thereof, and generally square in cross section, as best seen in FIG. 4. Projecting from adjacent corners of the frame member are a pair of flanges 50 and 52. The flanges extend parallel with one another to form a generally U-shaped channel 54, again as best seen in FIG. 4. As earlier mentioned, the frame members include holes 44 located near each end of the members either in the top walls of the members opposite the channel 54 (in the case of the top frame members 24) or in the bottom walls of the frame members which participate in forming the channels 54 (in the case of the bottom frame members 22 and vertical frame members 26). These holes are designed to receive the rigid nipples 42 projecting from the legs of the corner members or the nipples 46 of the detent apparatus disposed in the central posts 32.

The cross section of the central posts 32 and of the base portions of the legs 34 and 36 are dimensioned to fit snuggly in the ends of the frame members, with the ends of the frame members abutting against end faces 30*a* and 30*b* and the surface of the body 30 from which the central post 32 projects. The interior surfaces of the channels 54 of the frame members are dimensioned to receive edges of the end panels 10 and 12.

Flanges 60 are formed on the inner sides of the top frame members 24 and the bottom frame members 22 to project inwardly from the frame members toward the center of the cabinet frame 2. These flanges 60 provide a support for the top panel 4 and the bottom panel 6 as generally indicated in FIG. 1. Of course, other arrangements could be provided for supporting the top and bottom panels and the use of flanges 60 on the frame members is merely one way of doing this. (It might be noted that the use of such flanges was disclosed in the aforecited patent, U.S. Pat. No. 3,815,966.)

Base member supports 14 for the cabinet are shown in FIG. 3. The base members are formed of a generally flat plate 70 and a pair of upstanding ridges 72 and 74 formed on the plate 70. The ridges 72 and 74 extend laterally from a substantially square corner section 76 to form a right angle with respect to one another. The ridges 72 and 74 are shaped to be received snuggly within the channels 54 of the frame members. When the ridges 72 and 74 are inserted in the channels 54, the corner section 76 of the base member 14 abuts against the bottom face of the body 30 of the lower corner member 18. In this manner, the ridges 72 and 74 and the corner section 76 of the support member 14 provide support for corresponding lower frame members and corner members.

Advantageously, a wheel or caster assembly 16 may be mounted to the underneath surface of the base member 14 to enable ready movement of the cabinet. Such wheel or caster assembly could be secured to such underneath surface by screws, or suitable adhesive, etc.

As indicated earlier, FIG. 4 shows the details of the detent apparatus mounted in the central posts 32 of the corner members. This detent apparatus includes a spring 80 positioned in a hollowed out portion 82 of the central post 32. The spring 80 pushes against a nipple or ball end base 84 to thereby bias the nipple or ball end 46 outwardly of the central post 32 and into a hole 44 located in the channel 54 of a corresponding frame member. The nipple 46 may be forced inwardly by a knife blade, etc., in the well known manner to enable sliding the central post 32 into or out of the end of a frame member. Although the ball end base 84 is shown in engagement with a portion of the wall of central post 32 which surrounds the opening in the wall through which ball end 46 protrudes, it should be understood that such portion of the wall may be eliminated so that the ball end base 84 is held in place in the hollowed out portion 82 only when the central post 32 is inserted in a corresponding frame member. With this arrangement, the detent apparatus may be readily inserted and removed from the central post 32 since there is nothing to hold it in place until the central post is inserted in a frame member.

Figure 2C:
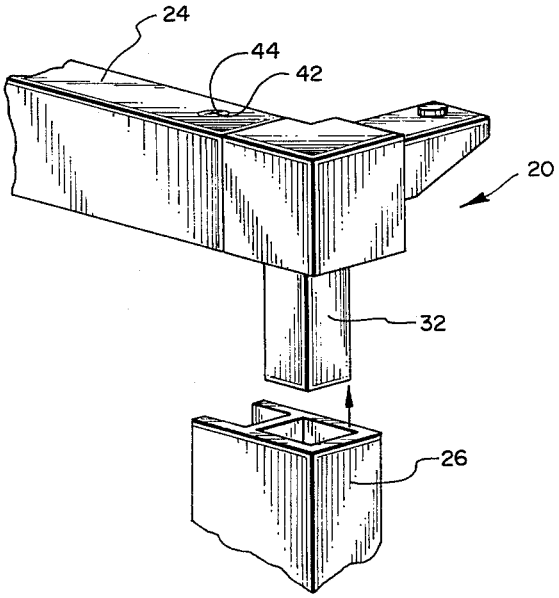

Assembly of the cabinet consists of coupling the corner members to the frame members and properly placing the panels among the frame members. The corner members are fitted into the ends of the frame members by a type of pivoting action best understood by reference to composite FIG. 2. Specifically, the narrow end of each leg is inserted in the end of a frame member as indicated generally in FIG. 2A until the upper portion of the flat end face 30b abuts against the end edge of the frame member 24 as indicated in FIG. 2B. By then pivoting the central post 32 downwardly and toward the frame member 24 as indicated by the arrow in FIG. 2B, the rigid nipple 42 which projects from the leg 36 moves into the hole 44 located in the top of the frame member. The corner member 20 is pivoted downwardly until the rest of the end face 30*b* abuts against the end of the frame member 24 as indicated in FIG. 2C. It should be understood, of course, that either the corner member may be pivoted into coupling engagement in the end of a frame member or alternatively that the frame member may be pivoted about the leg of a corner member.

The central posts 32 of the corner members may be simply slid longitudinally into the ends of the frame members as generally indicated in FIG. 2C. Of course, the detent apparatus of the central posts would be held in a depressed attitude while sliding the central post into the end of a frame member until the nipple of the detent apparatus became aligned with a corresponding hole in the frame member at which time the nipple would be biased outwardly into the hole as generally indicated in FIG. 4.

When the legs of a corner member are in place in the ends of corresponding frame members, and the central post 32 is held in a generally vertical attitude by a vertical frame member 26, the legs of the corner member cannot be withdrawn from the ends of the frame members because the nipples 42 are held in the holes 44. The cabinet is thus held in a mechanically stressed, substantially rigid configuration by reason of the structure of the corner members and frame members.

An exemplary procedure for assembling the entire cabinet is as follows. Two upper corner members 20 are pivoted into the two ends of the other top end frame member and then these two corner members are pivoted simultaneously into place on the ends of the front and back top frame members to thereby from an upper rectangle. The bottom frame members 22 and corner members 18 are similarly assembled to form a lower rectangle and then the vertical frame members 26 together with the end panels positioned therebetween are placed onto the central posts of the bottom corner members. The upper assembled rectangle is then placed onto the vertical frame members 26 so that the central posts of the upper corner members are inserted into the ends of the vertical frame members and so that the upper edges of the two end panels are received in the channels of corresponding top end frame members. The bottom panel 6, back panel 8 and top panel 4 may then be put in place as indicated in FIG. 1. It may be desirable to hold the back panel in position by some type of clip or adhesive or other fastening means. Finally, the base members 14 are inserted into position in the channels of the lower frame members 22 as generally indicated in FIG. 3. In the manner described, the cabinet may be quickly and easily assembled into a rigid, mechanically stressed structure.

It is to be understood that the above-described arrangement is only illustrative of the application of the principles of the present invention. Numerous other modifications and alternative arrangements may be devised by those skilled in the art without departing from the spirit and scope of the present invention and the appended claims are intended to cover such modifications and arrangements.

What is claimed is:

1. A cabinet structure comprising a plurality of elongate frame members, the ends of which are hollowed out to define sockets, and at least certain ones of which include a hole in a side wall of each socket, and a plurality of corner members for joining the ends of the frame members to form a cabinet structure, each of said corner members including a central post adapted to slide longitudinally into the sockets of the frame members, and a pair of legs extending substantially perpendicularly from one end of the central post at a predetermined angle with respect to each other, each leg having a rigid nipple protruding from one side of the leg opposite the side closest to the central post, with the other side of each leg being tapered such that the end of the leg is narrower than the base thereof to thereby enable slipping the leg into the sockets of the frame members so that the nipple of the leg is received into a hole of the sidewall of the sockets, four of said frame members being arranged to form a lower rectangle, four of said corner members being disposed at the corners of the rectangle, with the legs of each such corner members extending into corresponding contiguous sockets of the frame members and the central posts of such corner members extending upwardly, four other of said frame members being arranged to form an upper rectangle, four other of said corner members being disposed at the corners of the upper rectangle, with the legs of each such corner members extending into corresponding contiguous sockets of the upper frame members and the central posts of such corner members extending downwardly, and four of said frame members being arranged to extend generally vertically between corresponding corners of the lower and upper rectangles, with the central posts of corresponding corner members extending into the sockets of the verticle frame members to thereby provide a unified cabinet frame.

2. A cabinet structure as in claim 1 wherein the outside cross-sectional dimensions of said central posts and the bases of said legs are substantially the same as the inside cross-sectional dimensions of the sockets of said frame members.

3. A cabinet structure as in claim 2 wherein each of said frame members includes a pair of flanges which extend from one side of the frame member to form a generally U-shaped channel, said cabinet structure further comprising a plurality of panels for placement among the frame members so that at least a portion of the edges of the panels are received within channels of the frame members.

4. A cabinet structure as in claim 3 further comprising a plurality of base members, each including a base plate, and a pair of upstanding ridges formed on said base plate and adapted to fit snugly within the channels of said frame members.

5. A cabinet structure as in claim 3 wherein the channels of the frame members forming the lower rectangle face downwardly, wherein the channels of the frame members forming the upper triangle face downwardly, wherein the channels of a first pair of vertical frame members face each other and the channels of a second pair of vertical frame members face each other, wherein first and second panels are disposed within the first and second pair of vertical frame members respectively, the edges of the first and second panels being received into the channels of the vertical frame members and into the channels of corresponding ones of the frame members forming the upper rectangle, wherein the frame members of the upper and lower rectangle include flange means which project inwardly to define supports, and wherein third and fourth panels are disposed to rest on the flange means of the frame members of the upper and lower rectangles respectively.

6. A cabinet structure as in claim 1 wherein each of said corner members includes a detent means disposed in the central post of the corner member, said detent means having a ball end spring biased to project from the side of the center post, and wherein certain other of said frame members include a hole in a side wall of the sockets for receiving the ball end.

* * * * *